US006416091B1

(12) United States Patent
Wenk et al.

(10) Patent No.: US 6,416,091 B1
(45) Date of Patent: Jul. 9, 2002

(54) PADLOCK-TYPE SECURITY SEAL

(75) Inventors: Joseph Wenk, Huntington Bay; Ephraim Natkins, Jackson Heights, both of NY (US)

(73) Assignee: American Casting & Manufacturing Corporation, Plainview, NY (US)

( * ) Notice: Subject to any disclaimer, the term of this patent is extended or adjusted under 35 U.S.C. 154(b) by 0 days.

(21) Appl. No.: 09/794,527

(22) Filed: Feb. 27, 2001

(51) Int. Cl.[7] ..... B65D 33/34
(52) U.S. Cl. ..... 292/320; 292/307 R
(58) Field of Search ..... 292/307 R, 317–321

(56) References Cited

U.S. PATENT DOCUMENTS

| | | | | |
|---|---|---|---|---|
| 1,964,897 | A | 7/1934 | Wenk | |
| 2,006,042 | A | 6/1935 | Dietze | |
| 2,020,198 | A | 11/1935 | Miller | |
| 3,375,033 | A | 3/1968 | Moberg | |
| 3,485,521 | A | 12/1969 | Moberg | |
| 3,838,878 | A | * 10/1974 | Fernberg et al. | 292/318 |
| 3,980,332 | A | 9/1976 | King, Sr. | |
| 4,254,977 | A | 3/1981 | Guiler | |
| 4,278,281 | A | 7/1981 | Moberg | |
| 4,353,583 | A | 10/1982 | Moberg | |
| 4,687,240 | A | 8/1987 | Swift | |
| 4,733,893 | A | 3/1988 | Davis et al. | |
| 4,775,175 | A | 10/1988 | Swift | |
| 4,793,644 | A | 12/1988 | Swift | |
| 4,832,387 | A | 5/1989 | Guiler | |
| 4,836,590 | A | 6/1989 | Swift | |
| 4,887,855 | A | 12/1989 | Tritton et al. | |
| 4,893,853 | A | 1/1990 | Guiler | |
| 4,909,552 | A | 3/1990 | Weber et al. | |
| 5,314,219 | A | 5/1994 | Georgopoulous et al. | |
| 5,427,423 | A | 6/1995 | Georgopoulous | |

* cited by examiner

*Primary Examiner*—Teri Pham Luu
(74) *Attorney, Agent, or Firm*—Hoffmann & Baron, LLP

(57) ABSTRACT

A padlock-type security seal that generally includes a U-shaped resilient shackle having two legs and a body having two apertures formed in a first end thereof for insertion of the shackle legs. The apertures are positioned in the first end of the body along two separate offset planes to provide a torsional force to the shackle upon insertion. The torsional force acts on locking elements of the legs to engage the body thereby preventing removal of the shackle. The locking elements are reversibly bent tangs formed at the ends of the shackle legs at offset angles with respect to the plane of the shackle. At least one of the shackle legs preferably includes a bent hinge portion for transferring the torsional force to the locking elements. A locking insert contained within the body engages at least one of the locking elements of the shackle legs under the torsional force to prevent removal of the shackle.

23 Claims, 5 Drawing Sheets

PADLOCK-TYPE SECURITY SEAL

FIELD OF THE INVENTION

The present invention relates generally to a security seal of the padlock-type and, more particularly to a seal having a wire shackle that is first threaded through a structure to be secured and then locked in a body under a torsional force such that the seal must be broken to be opened.

BACKGROUND OF THE INVENTION

Padlock-type security seals have found widespread use as a means for securing electric meters and the like. Such seals generally include a plastic body with a pair of apertures opening at one end of the body and a shackle formed of a piece of U-shaped wire having legs with reversibly bent end portions. When the seal is put into use, the shackle legs are first threaded through a structure to be secured, such as a retaining ring fitted around a cover for an electric meter. The shackle legs are then inserted into the body apertures whereby the reversibly bent end portions engage some form of inner structure of the body for permanent retention. A lateral pulling force on the shackle only forces the reversibly bent end portions into stronger engagement with the body. Thus, the shackle must be severed or otherwise broken to open the seal.

In addition to the usual locking mechanisms, most seals include some form of tamper-indicating structure. Generally, tamper-indicating structures are designed such that any significant attempts to defeat or tamper with the seal will normally result in altering the seal in such a manner that the attempt will be readily detectable. For example, U.S. Pat. No. 4,893,853 to Guiler discloses a seal having taper-indicating means which causes the shackle ends to break through the walls of the body when an attempt is made to remove the shackle. U.S. Pat. No. 4,836,590 to Swift discloses a body having a brightly colored insert retained in the body. The insert retains the ends of the shackle and includes a frangible member that is fractured upon an attempt to remove the shackle. Such damage in both devices is readily apparent thereby indicating evidence of tampering.

Although such devices have served the purpose, they have not provided entirely satisfactory results, because some efforts to defeat such structures by picking have proved successful. One such method of picking involves inserting a picking tool into the seal body and deforming the shackle legs to an extent that the legs can freely be withdrawn from the sealed body, reformed, and later replaced in the seal body. Numerous efforts have been made to prevent picking as well. For example, U.S. Pat. No. 3,375,033 to Moberg discloses a shackle having reversibly bent portions that block insertion of a picking tool into the apertures of the body.

Although such efforts have proven reasonably successful, it is desirable to provide an inexpensive and easily installed single-use seal designed to strongly secure a structure and to both resist tampering and to permit easy detection of any tampering.

SUMMARY OF THE INVENTION

The present invention is a padlock-type security seal that generally includes a U-shaped resilient shackle having two legs and a body having two apertures formed in a first end thereof for insertion of the shackle legs. The apertures are positioned in the first end of the body to provide a torsional force to the shackle upon insertion. The torsional force acts on locking elements of the legs to engage the body thereby preventing removal of the shackle.

The locking elements of the shackle legs are preferably reversibly bent tangs formed at opposite offset angles with respect to the plane of the shackle. The apertures are preferably generally rectangular in cross-section and the major axes of the rectangular apertures are positioned in the first end of the body along two separate offset planes thereby providing the torsional force to the shackle. At least one of the shackle legs also preferably includes a bent hinge portion for transferring the torsional force to the locking elements. The shackle legs further preferably include inwardly bent portions for substantially occluding the leg insertion apertures to prevent insertion of a picking tool.

The seal further preferably includes a locking insert contained within the body for engaging at least one of the locking elements of the shackle legs under the torsional force to prevent removal of the shackle. The locking insert is inserted into a third aperture formed in a second end of the body opposite the first end that is in fluid communication with the other apertures. The locking insert includes at least one slot formed therethrough for engaging the locking element and preferably includes two slots forming an X-shaped aperture through the locking insert. For tamper indicating purposes, the body is preferably translucent while the locking insert is preferably opaque.

For a better understanding of the present invention, reference is made to the following detailed description, taken in conjunction with the accompany drawings and its scope will be defined in the appended claims.

DETAILED DESCRIPTION OF THE PREFERRED EMBODIMENTS

Figure 1:
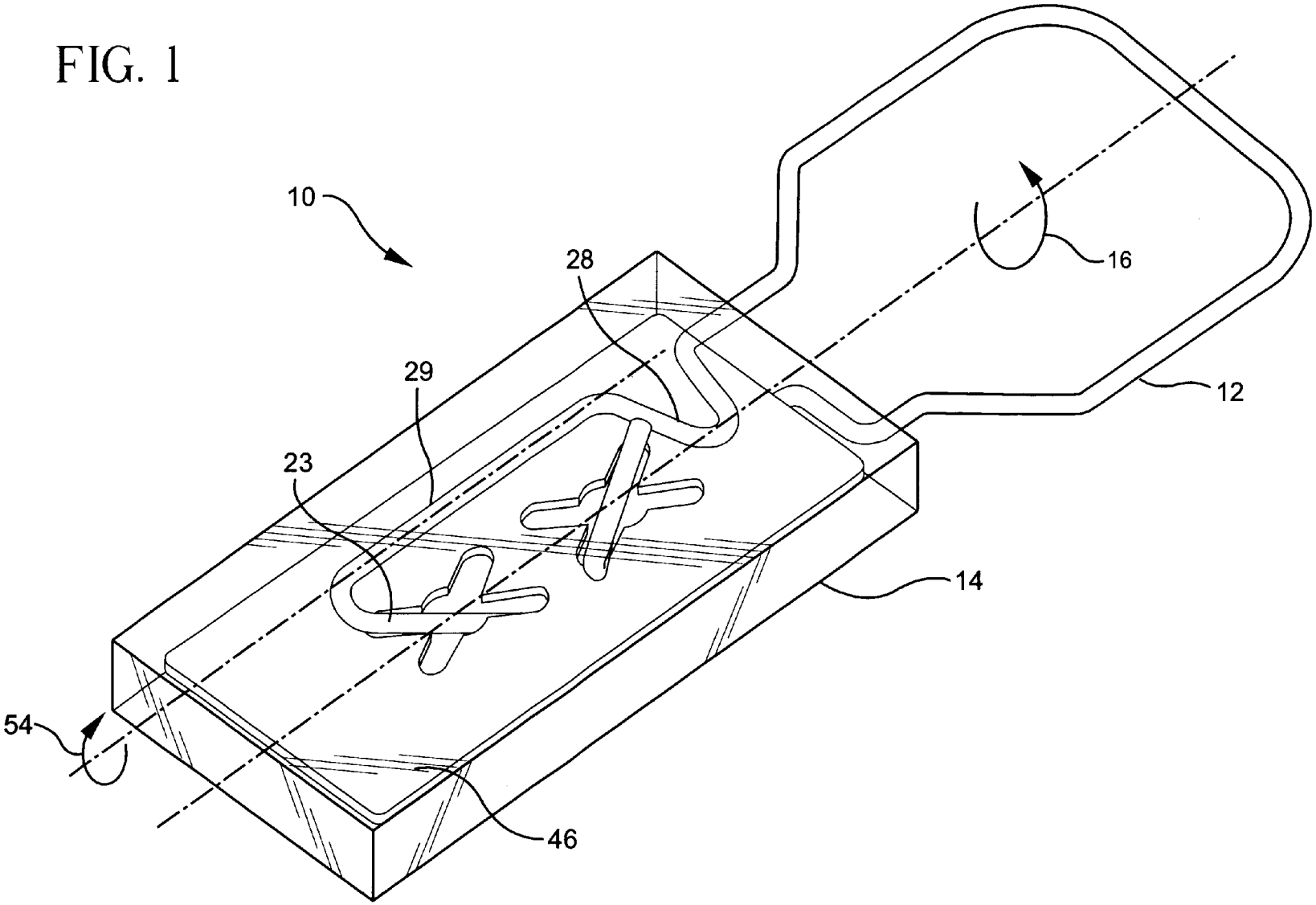
FIG. 1 is a top perspective view of the padlock-type security seal formed in accordance with the present invention.
Figure 2:
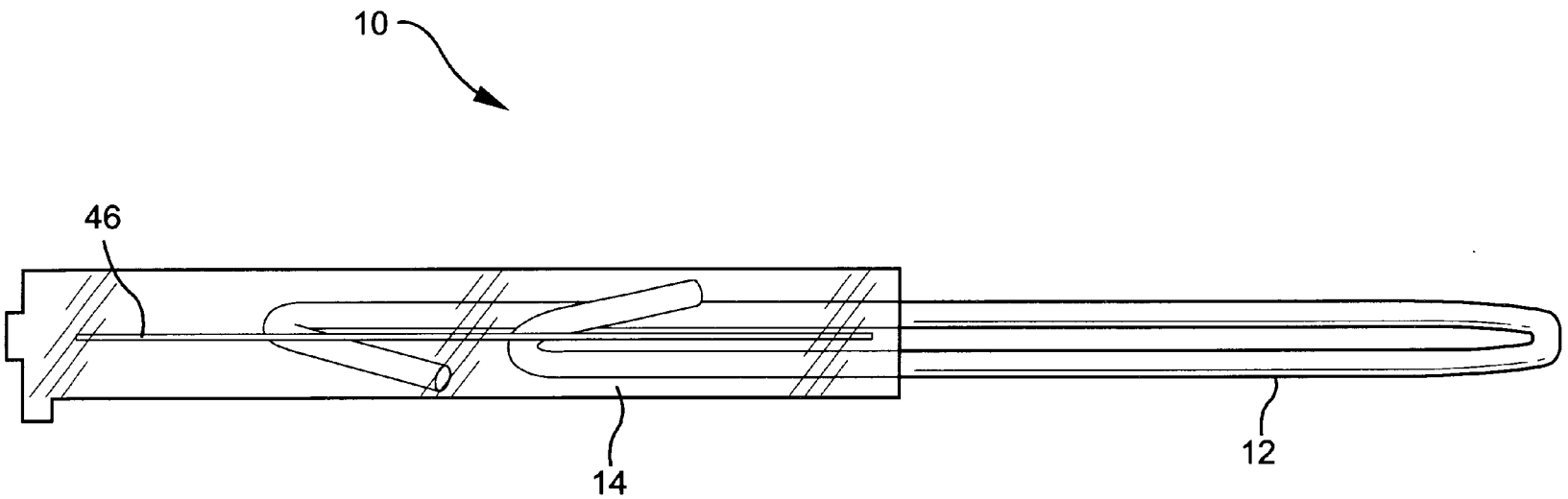
FIG. 2 is a side view of the padlock-type security seal shown in FIG. 1.

Referring first to FIGS. 1 and 2, a padlock-type security seal 10 formed in accordance with the present invention is shown. The seal 10 generally includes a U-shaped resilient shackle 12 inserted into a body 14. The shackle 12 is inserted into the body 14 such that a torsional force 16 is provided to the shackle which causes the shackle to engage the interior of the body, thereby preventing removal of the shackle from the body.

Figure 3:
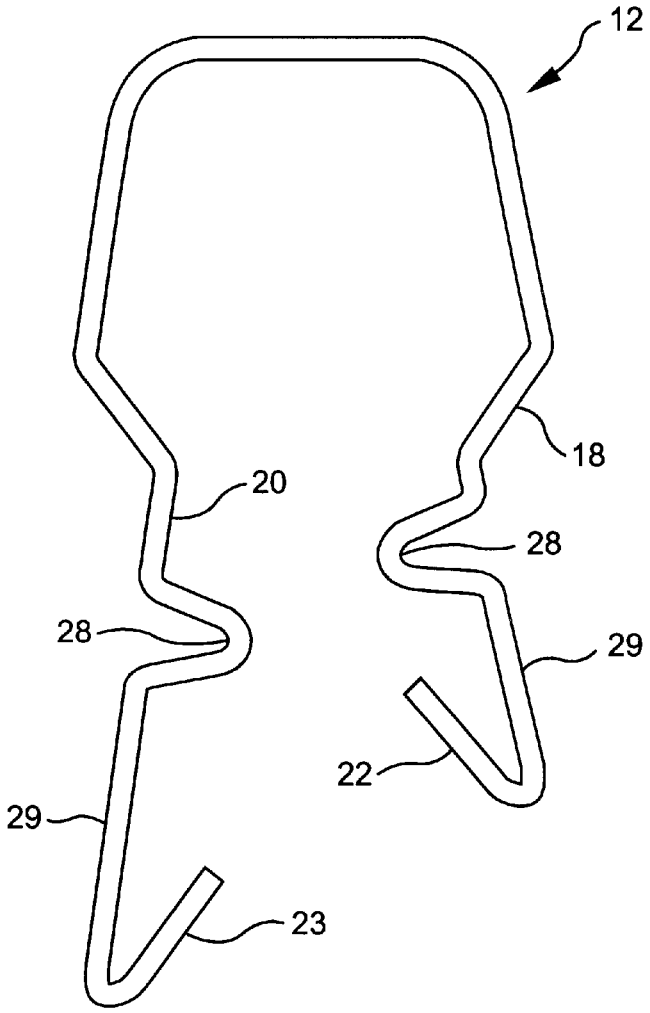
FIG. 3 is a top plan view of the shackle formed in accordance with the present invention.
Figure 4:
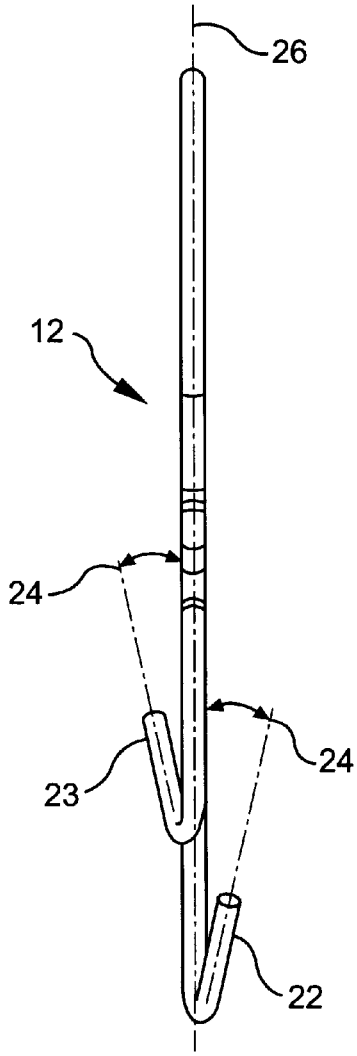
FIG. 4 is a side view of the shackle shown in FIG. 3.

Referring additionally to FIGS. 3 and 4, the U-shaped shackle 12 is made from a strong yet resilient material, such as spring steel. The shackle 12 includes downwardly extending first and second legs 18 and 20 each having a locking element 22 and 23, respectively, formed at an end thereon.

Preferably, the first leg 18 of the shackle 12 is shorter in length than the second leg 20. The locking elements 22 and 23 are preferably reversibly bent end portions of the legs thereby forming tangs. Referring specifically to FIG. 4, the reversibly bent tangs forming the locking elements 22 and 23 are formed at angles 24 with respect to the plane 26 of the shackle 12. The locking element 22 of the first leg 18 is formed at an angle in an opposite direction to the locking element 23 of the second leg 20 of the shackle 12. The shackle legs 18 and 20 also preferably include inwardly bent hinge portions 28 located approximately midway along the length of the shackle legs. As will be discussed in further detail below, the hinge portions 28 act to both transfer the torsional force 16 applied to the shackle 12 along leg portions 29 to the locking elements 22 and 23 and to further block or occlude insertion of a picking tool into the body 14 when the shackle is inserted in the body.

Figure 6:
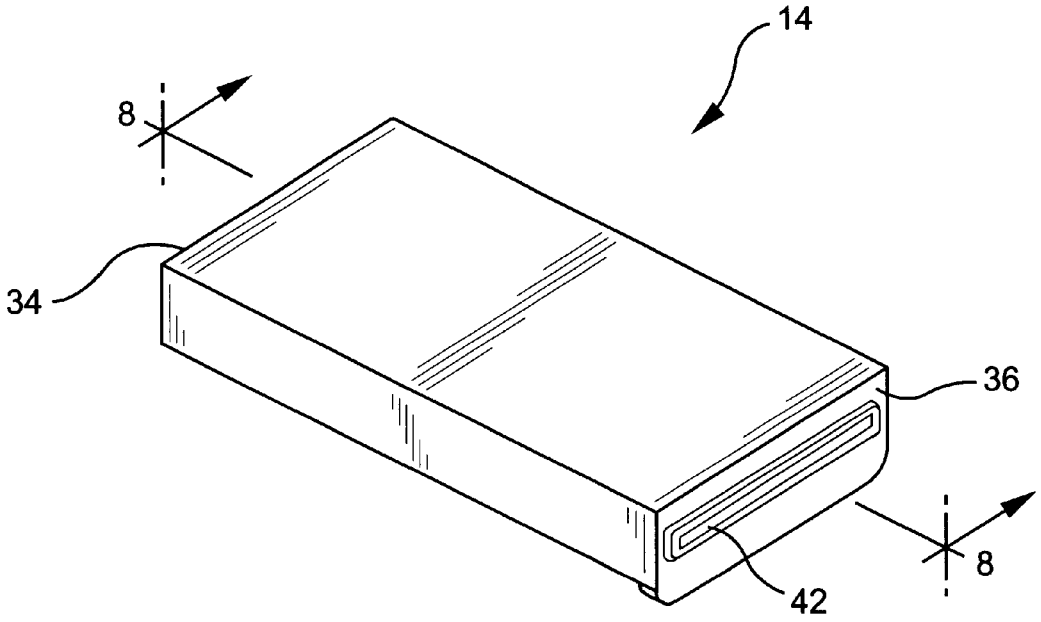
FIG. 6 is a top rear perspective view of the seal body formed in accordance with the present invention.
Figure 7:
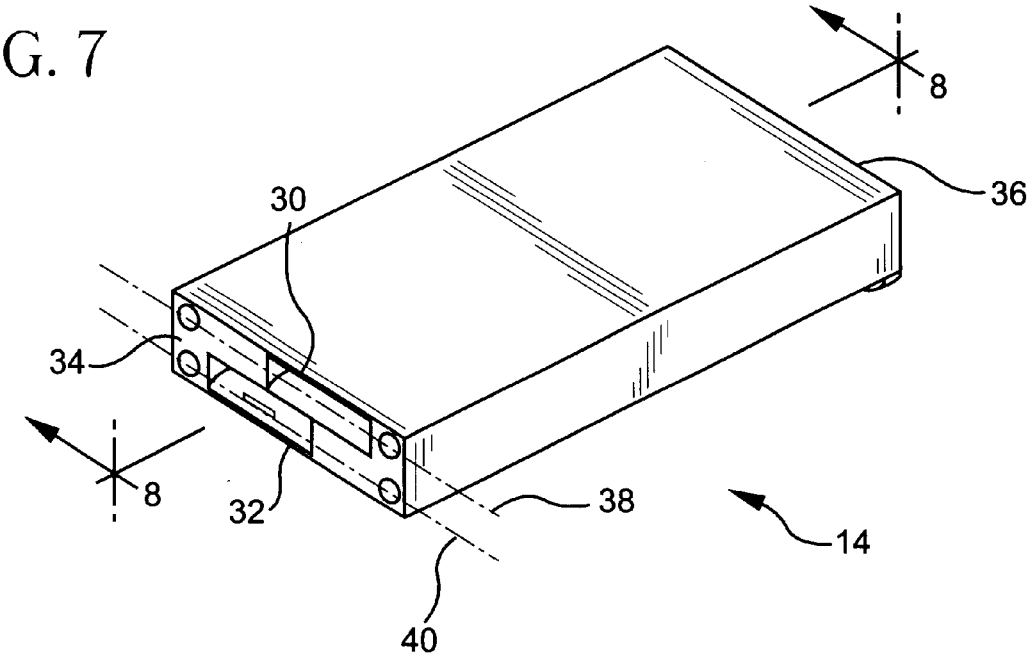
FIG. 7 is a top front perspective view of the seal body shown in FIG. 6.
Figure 8:
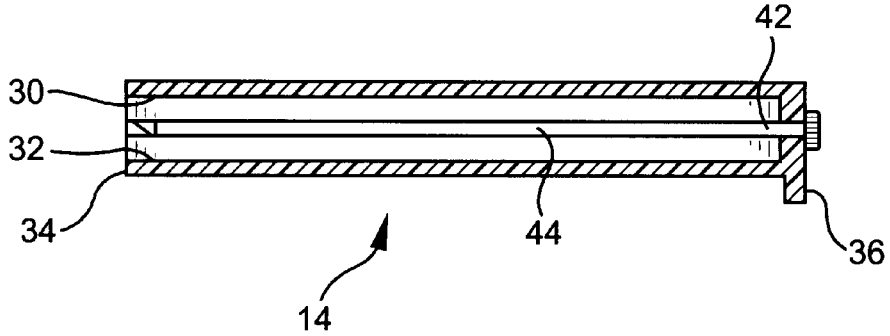
FIG. 8 is a cross-sectional view of the seal body shown in FIGS. 6 and 7 taken along the line 8—8.

Referring now to FIGS. 6–8, the body 14 of the seal 10 is shown. The body 14 may be made from any durable material and is preferably made from a high strength inexpensive plastic. Preferably, the body 14 is made from a translucent material so that any interior tampering of the seal 10 will be readily apparent. The body 14 is generally elongate so as to fully contain the shackle legs 18 and 20, but may be made in any desired shape. Referring specifically to FIGS. 7 and 8, the body 14 includes first and second apertures 30 and 32 formed within the body and extending from a first end 34 thereof and terminating approximate an opposite second end 36 of the body. The first and second apertures 30 and 32 are sized to receive the first and second legs 18 and 20, respectively, of the shackle 12 and are non-circular in cross-section so as to prevent individual rotation of the shackle legs when inserted into the body 14. The first and second apertures 30 and 32 shown in FIGS. 7 and 8 are rectangular in cross-section having major cross-sectional axes 38 and 40 that are substantially parallel but offset from each other such that the shackle legs 18 and 20 will be inserted into the body along two separate planes. Insertion of the shackle legs 18 and 20 into the body 14 along two separate offset planes will impart a twisting or torsional force on the shackle 12 as shown by the arrow 16 in FIG. 1. The torsional force 16 acts upon the shackle 12 through the hinge portions 28 thereby forcing the locking elements 22 and 23 in opposite directions within the first and second apertures 30 and 32. The locking elements 22 and 23 are thus forced into engagement with opposite inner surfaces of the apertures 30 and 32 under the torsional force. Once the locking elements 22 and 23 are engaged, removal of the shackle 12 from the body 14 is prevented.

Referring now to FIGS. 6 and 8, the body 14 further includes a third aperture 42 formed within the body between the first and second apertures 30 and 32 and extending from the second end 36 of the body and terminating adjacent the first end 34. The first, second and third apertures 30, 32 and 42 are in fluid communication within the body 14 thereby forming a hollow chamber 44 between the first and second apertures. To enhance engagement of the locking elements 22 and 23 of the shackle 12, a locking insert 46 is inserted in the third aperture 42 and contained within the body 14. The locking insert 46 is contained within the body 14 by sealing closed the third aperture 42 at the second end 36 of the body in a conventional manner, such as by ultrasonic welding.

Figure 5:
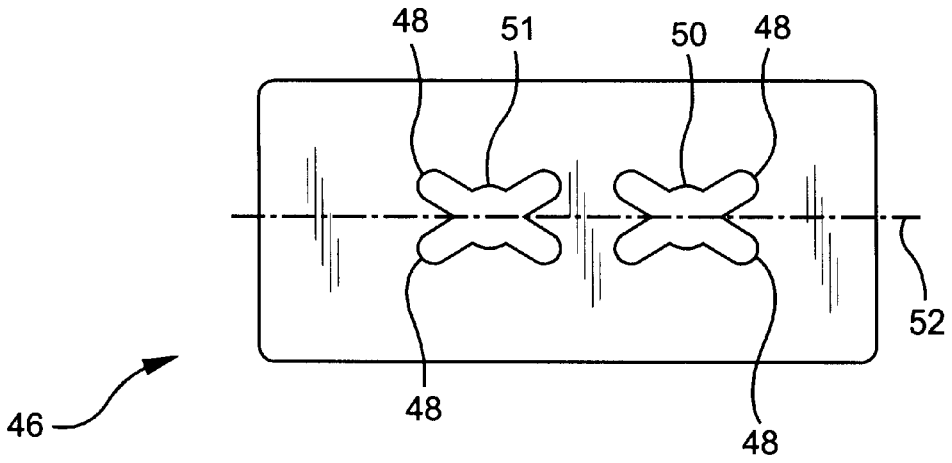
FIG. 5 is a top plan of the locking insert formed in accordance with the present invention.

As shown in FIG. 5, the locking insert 46 is preferably made from a thin sheet metal material and has one or more slots 48 formed therethrough. Preferably, the locking insert includes four slots 48 arranged in two X-shaped patterns, thereby forming two X-shaped apertures 50 and 51 formed through the locking insert 46 The two X-shaped apertures 50 and 51 are generally positioned along the centerline 52 of the locking insert 46. Preferably, the locking insert 46 is brightly colored and opaque so that any evidence of tampering with the insert is readily apparent through the translucent body 14.

Returning to FIGS. 1 and 2, when the first and second legs 18 and 20 of the shackle 12 are inserted into the first and second apertures 30 and 32 of the body 14, the locking elements 22 and 23 are initially forced into parallel alignment with the offset planes 38 and 40 of the first and second apertures. Because the locking elements are formed at angles 24 with respect to the plane 26 of the shackle 16, this creates an additional torsional force 54 acting about hinge portions 28 along the leg portions 29 of the shackle. As the legs 18 and 20 are further inserted into the body 14, the additional torsional force 54 forces the locking elements 22 and 23 to protrude through the X-shaped apertures 50 and 51, respectively, of the locking insert 46. The torsional forces 16 and 54 acting on the shackle 12 through the hinge portions 28 causes the locking elements 22 and 23 of the shackle 12 to not only engage the inner surfaces of the first and second apertures 30 and 32 of the body 14, but to also engage the locking insert 46. Thus, the combination of the torsional force 16 generated by inserting the shackle legs 18 and 20 along offset planes 38 and 40 and the torsional force 54 created by forming the locking elements 22 and 23 at angles 24 with respect to the shackle plane 26, along with the provision of a locking insert 46 that engages the locking elements, makes it extremely difficult to remove the shackle 12 from the body 14 once inserted.

The hinge portions 28 further act to occlude or block access to the apertures 30 and 32 of the body 14, thereby pre venting insertion of a picking tool into the body. With this arrangement, any such attempts at tampering with the seal 10 will cause some form of deformation to the body 14, the locking insert 46 and/or the shackle 12 that will be readily apparent through the translucent material of the body. Accordingly, the present invention provides an inexpensive and easily installed single-use seal that is designed to strongly secure a structure and to both resist tampering and to permit easy detection of any tampering.

While there has been described what is presently believed to be the preferred embodiment of the present invention, those skilled in the art will realize that various changes and modifications may be made to the invention without departing from the spirit of the invention, and it is intended to claim all such changes and modifications as fall within the scope of the invention.

What is claimed is:

1. A padlock-type security seal comprising:

a generally U-shaped resilient shackle having first and second legs, each of said first and second legs having a locking element thereon; and a body having a first aperture formed in a first end thereof for insertion of said first leg of said shackle and a second aperture formed in a first end thereof for insertion of said second leg of said shackle, said first and second apertures being positioned to provide a torsional force to said shackle upon insertion of said shackle, said locking elements of said first and second legs engaging said body under said torsional force to prevent removal of said shackle.

2. The seal as defined in claim 1, wherein said locking element is a reversibly bent tang.

3. The seal as defined in claim 2, wherein said reversibly bent tang is formed at an offset angle with respect to the plane of said shackle.

4. The seal as defined in claim 3, wherein said reversibly bent tang of said first leg of said shackle is formed at an offset angle generally opposite to said offset angle of said reversibly bent tang of said second leg of said shackle.

5. The seal as defined in claim 1, wherein said first and second apertures are generally rectangular in cross-section, the major axes of said first and second apertures being positioned in said first end of said body along two separate offset planes.

6. The seal as defined in claim 1, wherein said body includes a locking insert, at least one of said locking elements of said first and second legs of said shackle engaging said locking insert under said torsional force to prevent removal of said shackle.

7. The seal as defined in claim 6, wherein said body includes a third aperture formed in a second end of said body opposite said first end for insertion of said locking insert, said third aperture being in fluid communication with said first and second apertures.

8. The seal as defined in claim 6, wherein said locking insert includes at least one slot formed therethrough for engaging said at least one locking element.

9. The seal as defined in claim 8, wherein said locking insert includes two slots forming an X-shaped aperture through said locking insert for engaging said at least one locking element.

10. The seal as defined in claim 6, wherein said body is translucent and said locking insert is opaque.

11. The seal as defined in claim 1, wherein at least one of said first and second legs of said shackle includes an inwardly bent portion, said inwardly bent portion substantially occluding one of said first and second apertures upon insertion of said shackle legs into said body.

12. The seal as defined in claim 1, wherein at least one of said first and second legs of said shackle includes a bent hinge portion, said torsional force acting on said locking elements of said first and second legs through said hinge portion.

13. A padlock-type security seal comprising:

a generally U-shaped resilient shackle having first and second legs, each of said first and second legs having a reversibly bent tang formed at an end thereof at an offset angle with respect to the plane of said shackle; and a body having a first aperture formed in a first end thereof for insertion of said first leg of said shackle and a second aperture formed in a first end thereof for insertion of said second leg of said shackle.

14. The seal as defined in claim 13, wherein said first and second apertures are positioned in said first end of said body to provide a torsional force to said shackle upon insertion of said shackle, said reversibly bent tangs of said first and second legs engaging said body under said torsional force to prevent removal of said shackle.

15. The seal as defined in claim 14, wherein at least one of said first and second legs of said shackle includes a bent hinge portion, said torsional force acting on said reversibly bent tangs of said first and second legs through said hinge portion.

16. The seal as defined in claim 13, wherein said first and second apertures are generally rectangular in cross-section, the major axes of said first and second apertures being positioned in said first end of said body along two separate offset planes.

17. The seal as defined in claim 13, wherein said body includes a locking insert, at least one of said reversibly bent tangs of said first and second legs of said shackle engaging said locking insert upon insertion of said shackle into said body.

18. The seal as defined in claim 17, wherein said body includes a third aperture formed in a second end of said body opposite said first end for insertion of said locking insert, said third aperture being in fluid communication with said first and second apertures.

19. The seal as defined in claim 17, wherein said locking insert includes at least one slot formed therethrough for engaging said at least one locking element.

20. The seal as defined in claim 19, wherein said locking insert includes two slots forming an X-shaped aperture through said locking insert for engaging said at least one locking element.

21. The seal as defined in claim 17, wherein said body is translucent and said locking insert is opaque.

22. The seal as defined in claim 13, wherein at least one of said first and second legs of said shackle includes an inwardly bent portion, said inwardly bent portion substantially occluding one of said first and second apertures upon insertion of said shackle legs into said body.

23. The seal as defined in claim 13, wherein said reversibly bent tang of said first leg of said shackle is formed at an offset angle generally opposite to said offset angle of said reversibly bent tang of said second leg of said shackle.

* * * * *